US005509369A

United States Patent [19]

Ford et al.

[11] Patent Number: 5,509,369

[45] Date of Patent: Apr. 23, 1996

[54] SMALL WATERCRAFT AUTOMATIC STEERING APPARATUS AND METHOD

[75] Inventors: Douglas W. Ford; Eric K. Juve, both of Newport, Oreg.

[73] Assignee: Nautamatic Marine Systems, Newport, Oreg.

[21] Appl. No.: 320,533

[22] Filed: Oct. 11, 1994

[51] Int. Cl.[6] ..... B63H 25/22

[52] U.S. Cl. ..... 114/150; 440/61

[58] Field of Search ..... 114/144 R, 144 E, 114/150; 440/61; 318/588

[56] References Cited

U.S. PATENT DOCUMENTS

| | | | |
|---|---|---|---|
| 3,468,126 | 9/1969 | Mercier | 114/150 |
| 3,888,201 | 6/1975 | Zuvela | 114/144 R |
| 4,418,931 | 12/1983 | Howard | 280/90 |
| 4,564,909 | 1/1986 | Kramer | 364/457 |
| 4,578,039 | 3/1986 | Hall | 440/61 |
| 4,681,055 | 7/1987 | Cyr | 114/144 E |
| 4,933,617 | 6/1990 | Huber et al. | 318/588 |
| 5,057,043 | 10/1991 | Sugimoto et al. | 440/61 |
| 5,172,324 | 12/1992 | Knight | 364/457 |
| 5,235,927 | 8/1993 | Singh et al. | 114/144 E |
| 5,240,445 | 8/1993 | Aoki et al. | 440/58 |
| 5,244,426 | 9/1993 | Miyashita et al. | 440/60 |

*Primary Examiner*—Jesus D. Sotelo
*Attorney, Agent, or Firm*—Stoel Rives

[57] ABSTRACT

An automatic steering system (10) has a control subsystem (14) that employs a yaw rate control loop (90) and a steering control loop (92) to drive a hydraulic subsystem (12) in which the deflection rate of a steering actuator (16) is controlled without need for either a steering actuator angle sensor or an electronic steering bias integrator. Rather, the control subsystem employs a proportional rate servosystem to control the steering actuator deflection rate and a double-acting hydraulic cylinder (34) to provide the steering bias integral action. The control subsystem employs an electric compass (96) to generate heading data that are stored in a heading command register (102). A heading error is formed by calculating a difference between a desired heading and the current heading. A rate taker (94) generates a yaw rate feedback signal by differentiating changes in the current heading. The heading error and yaw rate feedback signal are processed to generate a steering rate command to which the steering control loop responds by pumping hydraulic fluid at a rate proportional to the steering rate command into the hydraulic cylinder to deflect the steering actuator of an outboard motor (18).

15 Claims, 6 Drawing Sheets

SMALL WATERCRAFT AUTOMATIC STEERING APPARATUS AND METHOD

TECHNICAL FIELD

This invention relates to marine autopilots and more particularly to a simplified and improved automatic steering system usable on outboard motor-propelled small boats.

BACKGROUND OF THE INVENTION

There are previously known systems for controlling the heading of a vehicle by deflection of a steering actuator. For example, to steer an automobile along a road, a driver deflects a steering wheel by an angle required to generate a desired turning rate. When a desired heading is reached, the steering wheel is centered to reduce the turning rate to zero. However, when encountering a crown in the road, a steering bias angle must be applied to the steering wheel to maintain the automobile on the road.

A skipper steers a boat in much the same manner by rotating a rudder, operating a tiller, or otherwise changing a thrust angle of a propelling force. However, when encountering a crosswind, crosscurrent, or other seastate condition, a steering bias angle must be applied to the steering actuator to maintain the desired heading. Steering bias is particularly necessary in small boats, which are susceptible to heading changes caused by variations in wind, tide, waves, wake, crew-induced listing, and off-center outboard motor mounting positions. Marine autopilot systems typically implement the steering bias angle by employing some form of an integrator that accumulates an error signal in a closed loop control system. Such systems are referred to as having "auto-trim."

The integrator is typically implemented by an electronic analog or digital integrator that is connected within the control loop that carries the heading or a heading error signal. The actual heading is typically generated by an electrical "flux gate" compass. Such control systems are referred to as position control systems and require some form of steering actuator angle sensor to close the loop. Unfortunately, it is not a straightforward task to adapt such a sensor to tiller-steered outboard motors, and none is known to have provisions for such a sensor. Moreover, existing position control-based marine autopilot systems have stability problems, as indicated by user controls to adjust for seastate conditions, rudder response, and damping.

Prior closed loop autopilot systems exist for watercraft that are steered by a wheel that is coupled to a cable or a hydraulic cylinder to turn a rudder or propulsion system. The wheel is readily adapted to include an actuator angle sensor. Commercially available closed loop autopilot systems that are adaptable to a cable or hydraulic steering system and have a seastate adjustment include the Navico Power Wheel PW5000, Benmar Course Setter 21, Furuno FAP-55, Robertson AP Series, Cetrek 700 Series, Si-Tex Marine Electronics SP-70, and Brooks and Gatehouse "Focus" and "Network" model autopilot systems. Some of the above-described autopilots are adaptable to inboard/outboard hydraulic steering systems, have handheld wired-remote control units, and include a built-in or remote flux gate compass.

A well-known provider of marine autopilot systems is Autohelm of Hudson, N.H., which manufactures the SportPilot, ST1000, ST4000, and ST5000 model autopilots. The Autohelm autopilots are adaptable to tiller, cable, or hydraulic, steering actuators, have four levels of steering trim adjustment, adaptive and programmable seastate adjustments, and variable rudder gain and damping adjustments.

The hydraulic steering systems employed in larger watercraft are typically high-pressure continuous flow types that employ expensive servovalves or modulated solenoids. In contrast, hydraulic steering systems for smaller watercraft are typically "hydrostatic" types that are smaller, simpler, and less expensive.

Some autopilot systems, particularly those for smaller watercraft, employ relatively simple "bang-bang" servo steering controllers. Unfortunately, such steering controllers consume excessive power typically require "dead-band," damping, rudder gain, and seastate adjustments. In small watercraft that typically have only a single 12-volt battery, power conservation is an important factor in ensuring reliable operation of running lights, radios, navigation equipment, water pumps, vent fans, and starter motors.

What is needed, therefore, is an automatic steering system for small watercraft that employs a self-trimming control system that does not require a steering actuator angle sensor or a seastate control for accurately and stably steering an outboard motor with a simple low power-consumption positioning system.

SUMMARY OF THE INVENTION

An object of this invention is, therefore, to provide a small watercraft automatic steering apparatus and a method for use with tiller-steered outboard motors.

Another object of this invention is to provide a simplified small watercraft automatic steering apparatus and a method that implement a self-trimming capability without requiring an actuator angle sensor.

A further object of this invention is to provide a small watercraft automatic steering apparatus and a method that is compact and lightweight, requires no seastate adjustment, and has low power consumption.

An automatic steering system of this invention has a control subsystem that employs a yaw rate control loop and a steering control loop to drive a hydraulic subsystem in which the deflection rate of a steering actuator is controlled without need for either a steering actuator angle sensor or an electronic steering bias integrator. Rather, the control subsystem employs a proportional rate servosystem to control the steering actuator deflection rate and a double-acting hydraulic cylinder to provide steering bias integral action.

The control subsystem employs a flux gate compass to generate heading data that are digitized and stored by a microprocessor in a heading command register. The microprocessor digitizes the current heading data and calculates a difference between a desired heading and the current heading to generate a heading error. A rate taker generates a yaw rate feedback signal from changes in the heading data. The heading error and yaw rate feedback signal are combined and multiplied by a gain factor to generate a steering rate command for use by the steering control loop.

The steering actuator control loop employs closed loop speed control of a pump motor to achieve tight steering rate regulation regardless of hydraulic cylinder load variations. The pump motor drives a gear pump that pumps hydraulic fluid at a rate proportional to the pump motor speed into the hydraulic cylinder to deflect the steering actuator such as the tiller of an outboard motor.

Additional objects and advantages of this invention will be apparent from the following detailed description of a preferred embodiment thereof that proceed with reference to the accompanying drawings.

DETAILED DESCRIPTION OF A PREFERRED EMBODIMENT

Figure 1:
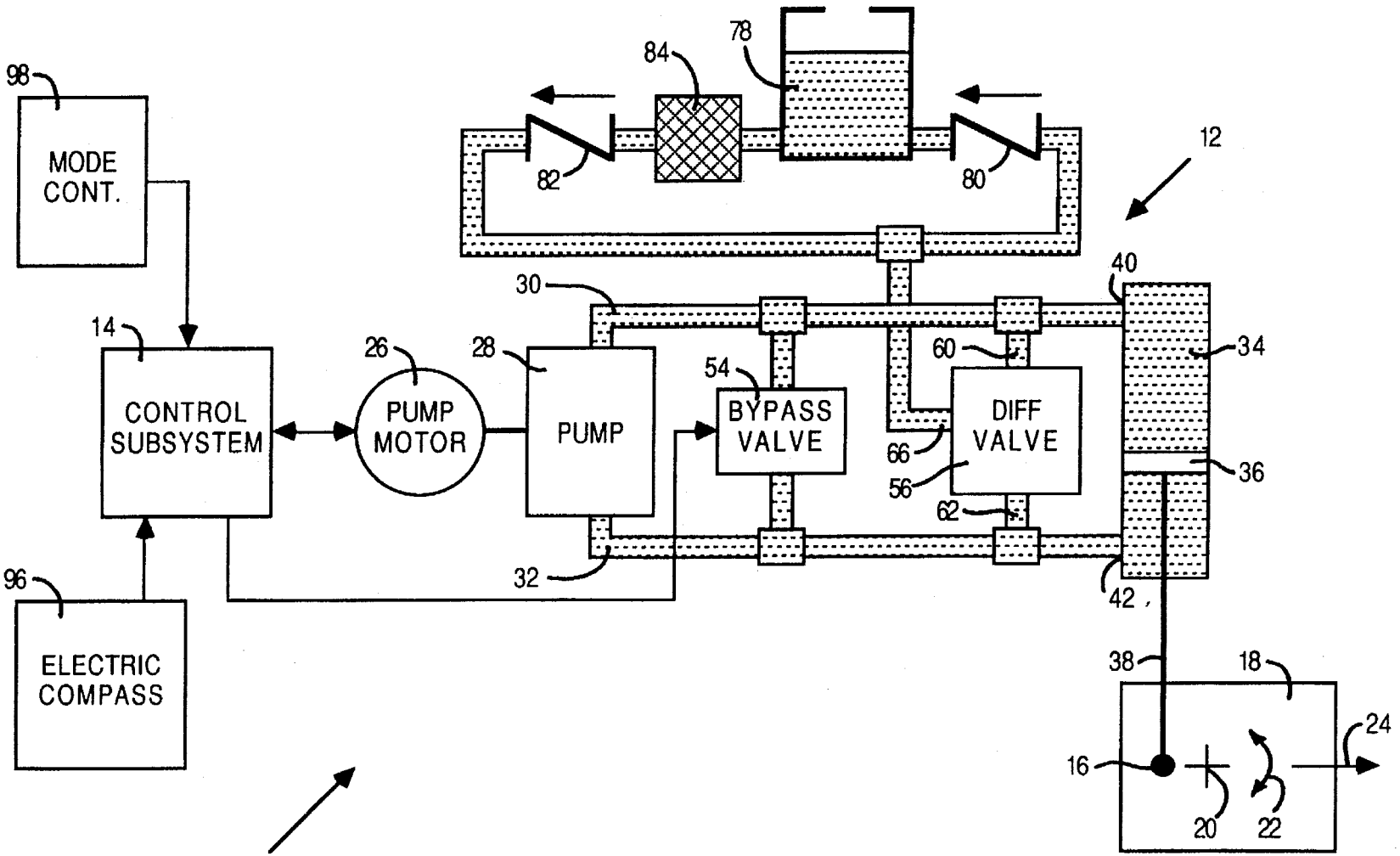
FIG. 1 is an overall simplified schematic block diagram showing hydraulic and control subsystems of an automatic steering system of this invention.

FIG. 1 shows an automatic steering system 10 of this invention having a hydraulic subsystem 12 and a control subsystem 14.

Hydraulic subsystem 12 is of a fixed displacement pump and hydraulic motor (cylinder), variable speed pump system type that is advantageous over many conventional systems because it does not require expensive servovalve actuators and pressure regulating valves.

Hydraulic subsystem 12 is different from conventional position responsive hydraulic systems because it receives only a steering rate command and responds by pumping hydraulic fluid into a double acting hydraulic cylinder at a rate proportional to the command. The hydraulic cylinder moves a piston that is coupled through a piston rod to a steering actuator. Hydraulic subsystem 12 is analogous to an integrator in that the piston rod moves the steering actuator at a rate and in a direction proportional to the steering rate command. When a particular steering rate command is received, the piston rod will continue to move until another command is received that either stops or reverses the piston movement.

Therefore, hydraulic subsystem 12 functions as a direct deflection rate controller for a steering actuator 16, such as a tiller on an outboard motor 18. Deflecting steering actuator 16 causes outboard motor 18 to pivot about an axis of rotation 20 in angular directions indicated by a double-ended arrow 22, and propulsive thrust developed by outboard motor 18 is thereby controllably directed in a direction indicated by an arrow 24.

Deflection rate control of steering actuator 16 is directly proportional to a bidirectional rotational velocity of an electric pump motor 26 that directly drives a gear pump 28, which, in turn, pumps hydraulic fluid through hydraulic lines 30 and 32 at a flow rate that is nearly linearly proportional to the rotational velocity. The hydraulic fluid is pumped into a hydraulic cylinder 34 of preferably a double-acting, single rod type in which motion of a piston 36 is directly proportional to the flow rate and flow direction of the hydraulic fluid. Piston 36 is attached to a piston rod 38 that is mechanically coupled to steering actuator 16 such that outboard motor 18 rotates in directions 22 when piston rod 38 is extended or retracted from hydraulic cylinder 34.

Pump motor 26 is preferably a permanent magnet, direct-current, brush commutator type electric motor capable of producing about 2,150 gram-centimeters (30 ounce-inches) of torque with 12 volts applied. A preferred motor is available as model number SCS-37A manufactured by Motor Products Owosso Corporation, Owosso, Mich.

In response to pump motor 26, gear pump 28 pumps hydraulic fluid at a maximum pressure of 10.2 kilograms per square centimeter (145 pounds per square inch) into either a first end 40 or a second end 42 of hydraulic cylinder 34 depending on the rotational direction of pump motor 26. The maximum hydraulic pressure is a typical pneumatic system pressure that provides sufficient pressure to deflect steering actuator 16 while protecting hydraulic subsystem 12 from unsafe pressures without requiring safety valves. For example, when piston rod 38 is at either end of its travel, gear pump 28 simply stalls.

Figure 2:
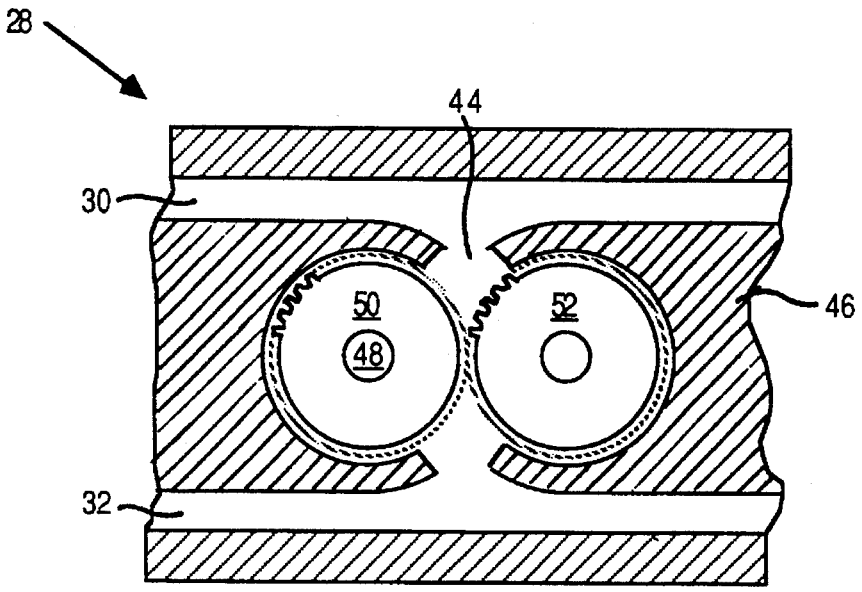
FIG. 2 is a fragmentary top view showing a gear pump of this invention with the cover removed to reveal the positional relationship among hydraulic fluid lines, pump gears, and a pump cavity.

FIG. 2 shows that gear pump 28 is of a type having a cavity 44 formed within a housing 46. Pump motor 26 (not shown) bidirectionally drives a spindle 48 to which a first gear 50 is attached and meshes with a second gear 52. Gears 50 and 52 and cavity 44 are sized to provide sufficient clearance for free rotation of gears 50 and 52 while minimizing hydraulic fluid leakage around their peripheries. At least a portion of each of hydraulic lines 30 and 32 is also formed within housing 46.

Referring again to FIG. 1, a bypass valve 54 selectively engages hydraulic subsystem 12 to enable automatic operation of steering actuator 16. Bypass valve 54 is of a rotary type that is normally open to shunt hydraulic fluid around gear pump 28 and is closed by a linear-to-rotary solenoid actuator that is electrically connected to control subsystem 14 to enable hydraulic subsystem 12. When bypass valve 54 is normally opened, piston 36 encounters only a fluid damping type resistance to motion within hydraulic cylinder 34, thereby allowing manual steering of outboard motor 18.

A differential valve 56 prevents hydraulic lock and proportions differential hydraulic fluid volumes that are caused by displacements of piston 36 within hydraulic cylinder 34; hydraulic fluid leakage around piston 36 and gear pump 28; hydraulic fluid losses from hoses, clamps, seals, and evaporation; and hydraulic fluid thermal expansion.

Figure 3:
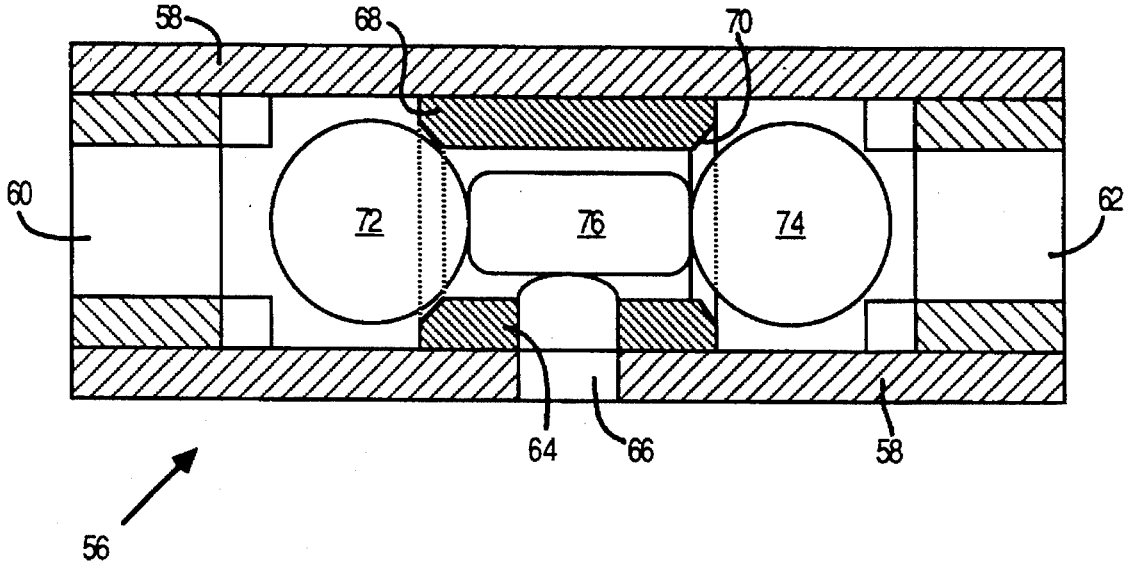
FIG. 3 is a cross-sectional view showing a differential valve of this invention.

FIG. 3 shows in cross-section differential valve 56, which is a hydrodynamically self-actuating three-port valve assembled in a cylindrical cavity formed in a rectangular aluminum housing 58. A pair of Delryn® main port fittings 60 and 62 and a Delryn® valve seat housing 64 are pressed into the bore of housing 58 as shown. Main port fittings 60 and 62 are fluidically connected respectively to hydraulic lines 30 and 32, which in turn are connected to ends 40 and 42 of hydraulic cylinder 34 (FIG. 1). A center port 66 is transversely formed in valve seat housing 64 to fluidically communicate with a pair of tapered valve seats 68 and 70 positioned at each end thereof. A pair of polypropelene valve balls 72 and 74 are spaced apart about 1.1 centimeters (0.430 inch) from each other by a push rod 76. Polypropelene was chosen for valve balls 72 and 74 because it is nearly neutrally buoyant in hydraulic fluid.

Referring also to FIG. 1, differential valve 56 blocks hydraulic fluid flow between the high pressure side of hydraulic subsystem 12 and center port 66 while simultaneously opening the low pressure side hydraulic subsystem 12 to a hydraulic fluid reservoir 78. By way of example, assume that hydraulic line 30 temporarily carries a higher hydraulic pressure than hydraulic line 32. The higher pressure at main port 60 forces valve ball 72 against tapered valve seat 68 and thereby prevents hydraulic fluid flow from main port 60 to center port 66. The closed position of valve ball 72 is translated by push rod 76 to valve ball 74 such that valve ball 74 is spaced apart from tapered valve seat 70, thereby opening main port 62 to center port 66.

Center port 66 is fluidically connected through a check valve 80 to allow any excess volume of hydraulic fluid to flow from the low pressure side of hydraulic subsystem 12 into hydraulic fluid reservoir 78. Conversely, whenever hydraulic subsystem 12 contains an insufficient volume of hydraulic fluid, center port 66 is further fluidically connected through a check valve 82 that allows hydraulic fluid to flow from hydraulic fluid reservoir 78, through a filter 84, and into the low-pressure side of hydraulic subsystem 12.

Automatic steering system 10 differs from prior position sensing systems because neither a steering actuator angle sensor nor an electronic steering bias integrator is required. Rather, control subsystem 14 of automatic steering system 10 employs a proportional rate servosystem to measure and control the steering actuator deflection rate. The integral action required to generate steering bias is provided by hydraulic cylinder 34 as it accumulates hydraulic fluid.

Figure 4:
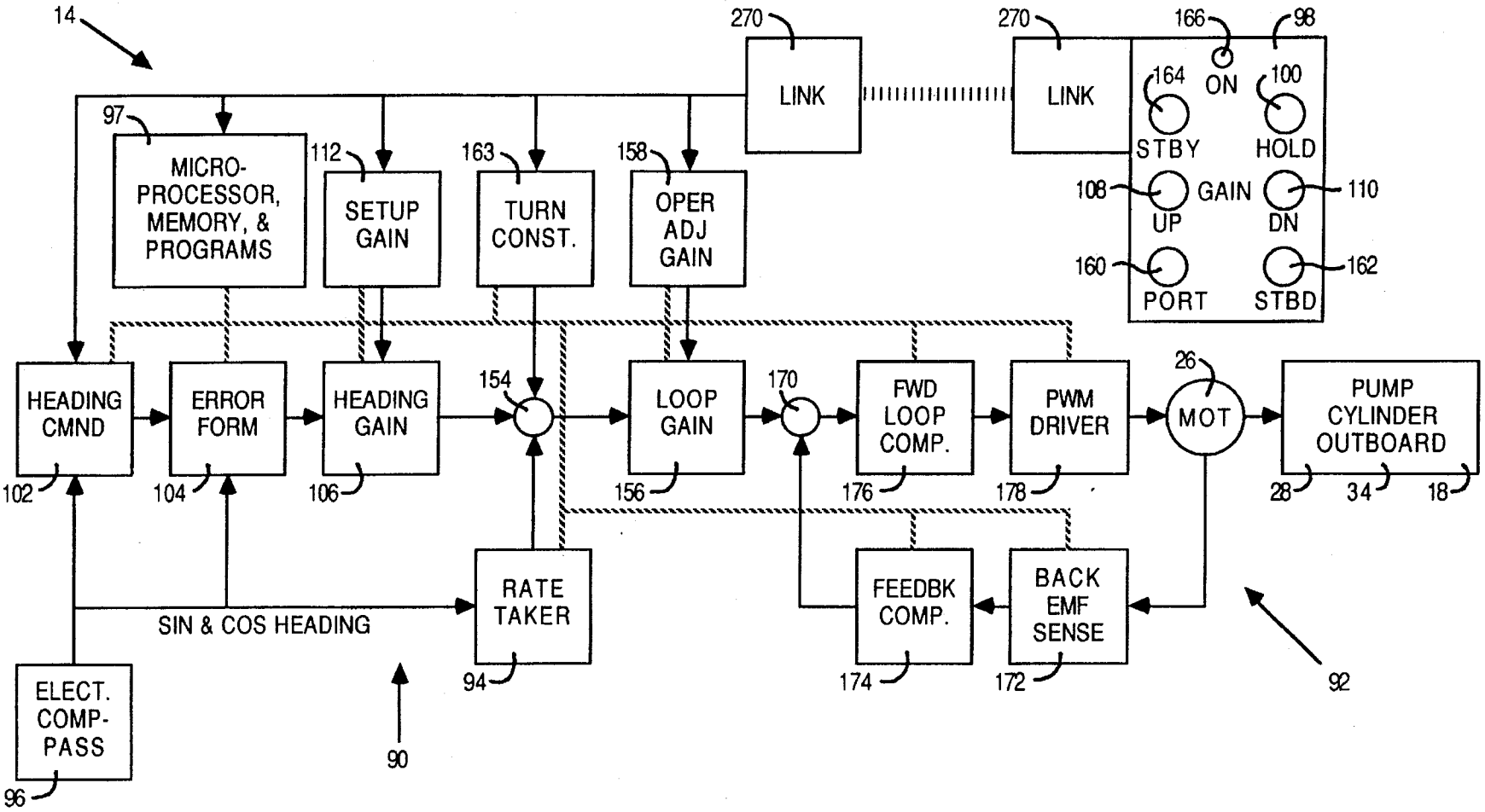
FIG. 4 is a block diagram showing a control subsystem of this invention.

FIG. 4 shows control subsystem 14 that employs an inner yaw rate control loop 90 driven by an outer steering control loop 92. A rate taker 94 generates a yaw rate feedback signal that is derived from magnetic heading sine and cosine signals received from an electric compass 96, such as a conventional flux gate compass. A preferred flux gate compass is the model AC-75 manufactured by KVH Industries, Inc., Middletown, R.I.

A microprocessor 97, preferably a model 87C576 manufactured by Philips Semiconductors, controls various calculations, samples and digitized data, stores data in registers and memory, runs control programs, and directs data flow as described below.

A handheld mode controller 98 includes a hold button 100, which when depressed causes the desired heading data received from electric compass 96 to be digitized, filtered, and stored by microprocessor 97 in a heading command register 102.

Microprocessor 97 digitizes and filters the current magnetic heading data received from electric compass 96, calculates a difference, if any, between the desired heading data and the current heading data, and stores the result as heading error data in an error formation register 104.

A heading gain multiplier 106 scales the heading error data by a setup gain factor to generate a yaw rate command for use in yaw rate control loop 90. Mode controller 98 includes respective gain up and gain down buttons 108 and 110, which when depressed during a setup mode are sensed by microprocessor 97, converted to the setup gain factor, and stored in a setup gain register 112 for use by heading gain multiplier 106.

Figure 5:
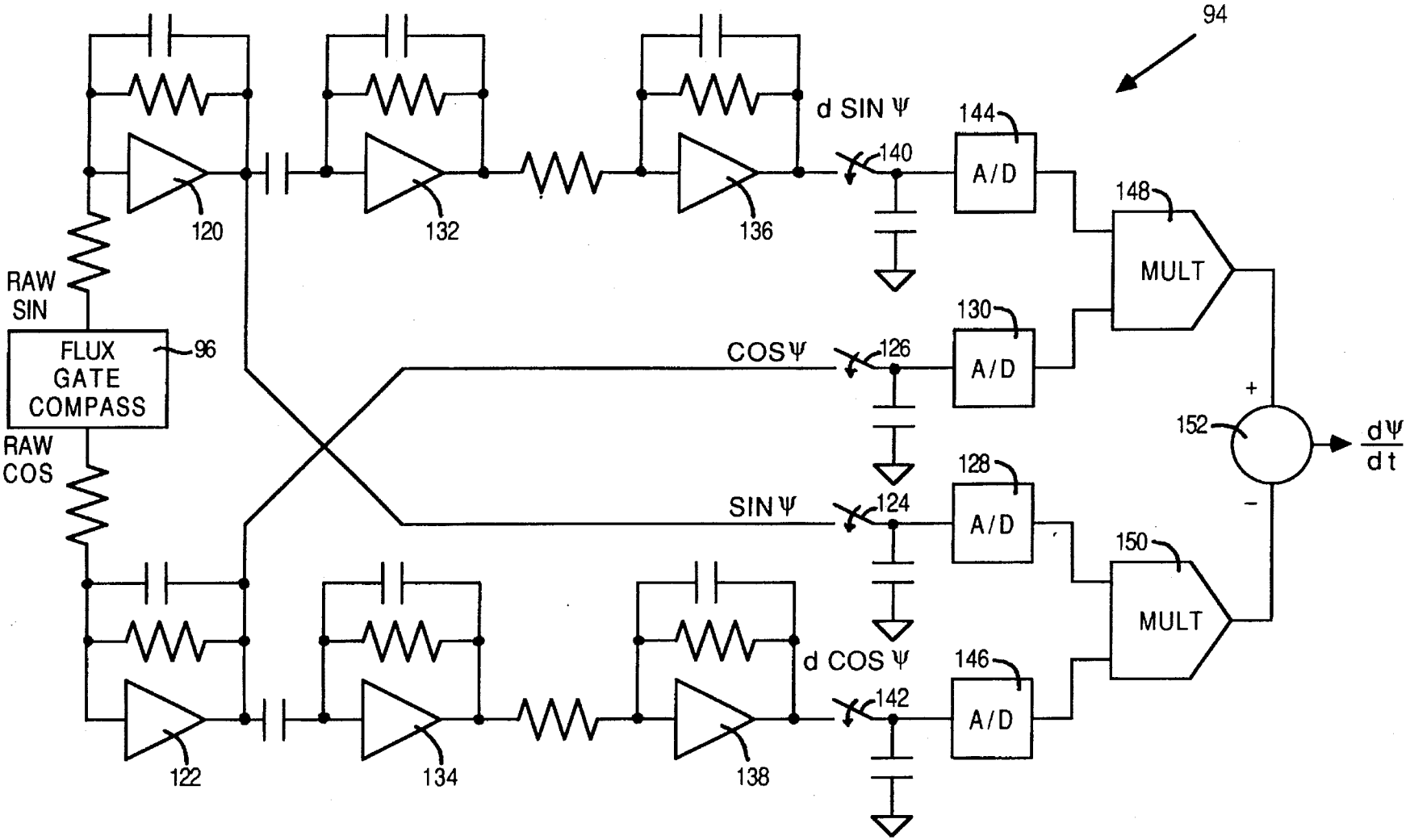
FIG. 5 is a combined simplified circuit diagram and processing block diagram showing a rate taker of this invention.

Rate taker 94 is described below with reference to FIGS. 4 and 5. Electric compass 96 generates a pair of analog voltages, Raw sin and Raw cos, that are proportional to the sine and cosine of the current magnetic heading. Raw sin and Raw cos are, respectively, anti-alias filtered by low-pass active filters 120 and 122, sampled by sample-and-hold circuits 124 and 126, and 10-bit digitized by analog-to-digital ("A-to-D") converters 128 and 130.

The filtered sine and cosine signals at the outputs of low-pass active filters 120 and 122 are also respectively differentiated by active differentiators 132 and 134, anti-alias filtered by low-pass active filters 136 and 138, sampled by sample-and-hold circuits 140 and 142, and 10-bit digitized by A-to-D converters 144 and 146 to generate signals that approximate the rate of change of the sine and cosine of the magnetic heading. The above-described active filters and differentiators are preferably each implemented with a model LM324N linear amplifier manufactured by National Semiconductor Corporation.

Microprocessor 97 performs the above-described sampling and digitizing functions and executes multiplying steps 148 and 150 and a summing step 152 on the digitized data to calculate an estimated yaw rate based on the following equations:

$$\frac{d(\sin\psi)}{dt} = \frac{d\psi}{dt}\cos\psi$$

$$\frac{d(\cos\psi)}{dt} = \frac{d\psi}{dt}\sin\psi$$

$$\frac{d(\sin\psi)}{dt}\cos\psi - \frac{d(\cos\psi)}{dt}\sin\psi = \frac{d\psi}{dt} = yaw\ \mathrm{rate}(r)$$

Referring again to FIG. 4, a summing junction 154 receives yaw rate (r) from rate taker 94 and subtracts it from the yaw rate command received from heading gain multiplier 106 to form a yaw rate error that is scaled by a loop gain multiplier 156 to produce a steering rate command for use by steering control loop 92.

Gain up and gain down buttons 108 and 110 of mode controller 98, when depressed during an automatic steering mode, are sensed by microprocessor 97, converted to a loop gain factor, and stored in an operator adjustable gain register 158 for use by loop gain multiplier 156.

Microprocessor 97 avoids processing time-consuming trigonometric functions by calculating the yaw rate error from the sine of the difference between the desired heading and the current heading data stored in heading command register 102. Recalling that the filtered, sampled, and digitized heading sine and cosine data are available as digital numbers at A-to-D converters 128 and 130 (FIG. 5), microprocessor 97 employs the following equation to calculate the heading error:

$$\sin(\psi_{hold}-\psi)=\sin\psi_{hold}\cos\psi-\cos\psi_{hold}\sin\psi\cong\psi\mathrm{error}$$

Because control subsystem 14 employs yaw rate, turn steering commands are implemented by simply adding a desired turning yaw rate constant ($r_c$) to yaw rate control loop 90 at summing junction 154 and zeroing any yaw rate command stored in heading command register 102 and passed through error formation register 104. Mode controller 98 includes respective port and starboard turn buttons 160 and 162, which when depressed during the automatic steering mode are sensed by microprocessor 97 which generates and stores the yaw rate constant ($r_c$) in a turning constant register 163. Repeated depressions of turn buttons 160 or 162 cause the yaw rate constant ($r_c$) stored in turning constant register 163 to increase (increasing starboard turn) or decrease (increasing port turn) by increments in accordance with the following equation:

$$r_c = r_c + (\text{starboardpushed} - \text{portpushed}) \times \text{rate increment per push.}$$

Yaw rate constant ($r_c$) is reset to zero when entering the automatic steering mode by depressing hold button 100 or when exiting the automatic steering mode by depressing a standby button 164.

Automatic steering mode is indicated by illuminating an indicator 166 on mode controller 98. Turning factors starboardpushed and portpushed are initialized to zero and preferably increment by one during the first iteration of the control program following a depression of port button 160 or starboard button 162.

Steering control loop 92 employs closed loop speed control of pump motor 26 to achieve tight steering rate regulation regardless of hydraulic cylinder 34 load variations caused by forces such as outboard motor 18 propeller torque, seastate, current, wind, and friction.

Overall operation of steering control loop 92 employs a summing junction 170 to receive the steering rate command from loop gain multiplier 156 and subtract therefrom an estimated motor speed received from a motor speed sensing circuit 172 and a feedback compensating process 174. The resulting motor speed error signal is received by a forward loop compensating process 176 and converted to pulse-width modulated ("PWM") drive signals by a PWM process 178 that controls pump motor 26.

Figure 6:
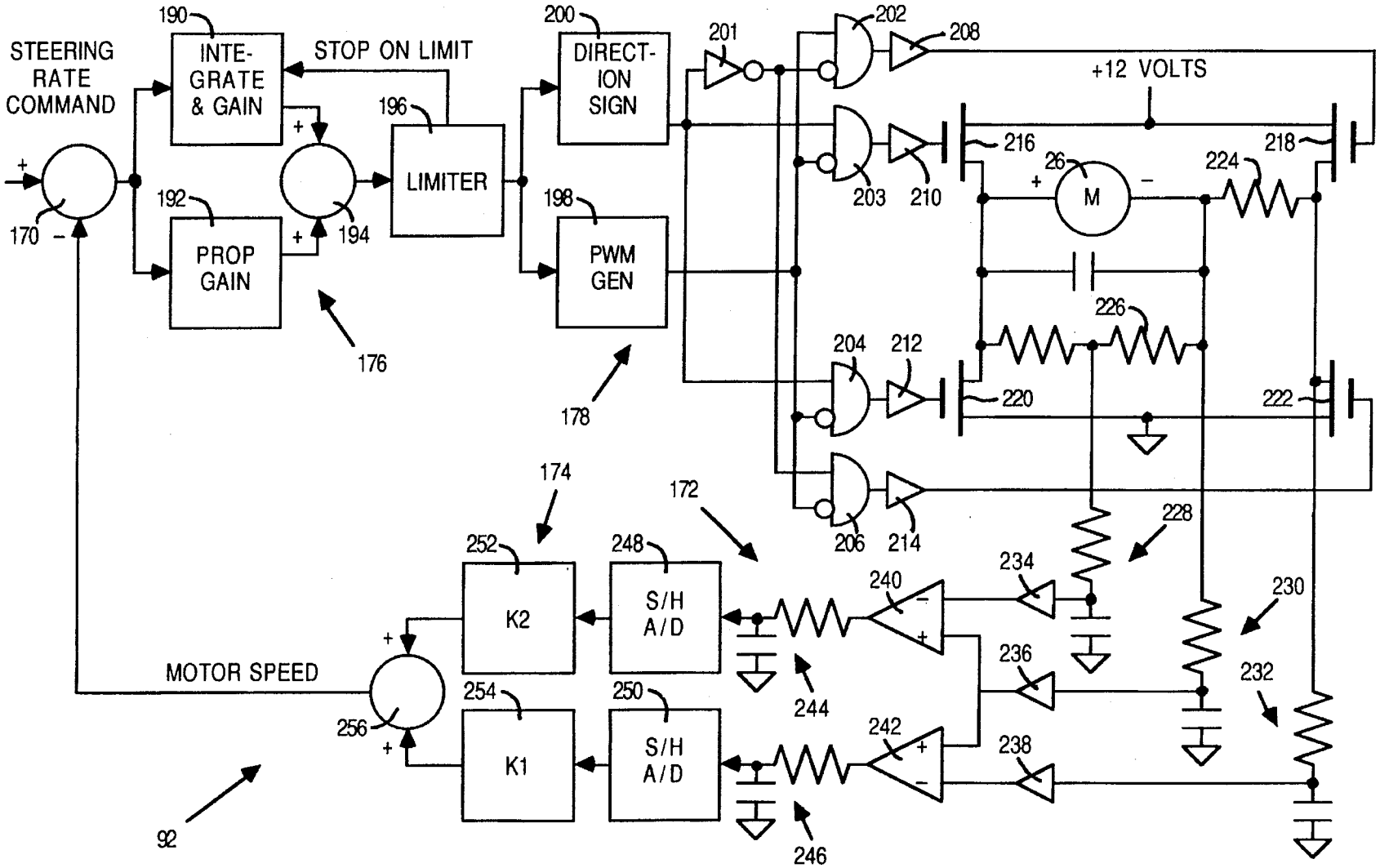
FIG. 6 is a combined simplified circuit diagram and processing block diagram showing pump motor drive and speed sensing circuits and steering control loop compensators of this invention.

FIG. 6 shows summing junction 170 receiving the steering rate command and estimated motor speed. Forward loop compensating process 176 entails receiving the motor speed error signal by an integrator and gain scaler 190 and a proportional gain scaler 192. Integrator and gain scaler 190 is implemented by incrementing or decrementing an 8-bit register in microprocessor 97 as a function of time and the sign of the motor speed error signal. The accumulated (integrated) value is then multiplied by a constant that is chosen to properly scale the accumulated value to match the torque versus applied voltage characteristics of pump motor 26. Proportional gain scaler 192 multiplies the magnitude of the motor speed error signal by a similarly chosen constant.

A summing junction 194 combines the signals generated by integrator and gain scaler 190 and proportional gain scaler 192, and the sum is received by a limiter 196 that prevents the 8-bit register in integrator and gain scaler 190 from exceeding its 255 count limit.

PWM process 178 entails passing the sum generated by summing junction 194 through limiter 196 to a PWM generator 198 that detects the magnitude of the processed motor speed error signal and generates a digital PWM signal having a duty cycle proportional to the magnitude.

The sum generated by summing junction 194 is also received by a direction sensor 200 that detects the sign of the processed motor speed error signal to command steering logic elements 201, 202, 203, 204, and 206 to direct the digital PWM signal through drivers 208, 210, 212, and 214 to appropriate alternate sides of an H-bridge formed by power field-effect transistor ("FET") devices 216, 218, 220, and 222. If FET devices 216 and 222 are driven by the PWM signal, electrical current will flow through pump motor 26 in a first direction. Conversely, if FET devices 218 and 220 are driven by the PWM signal, electrical current will flow through pump motor 26 in the opposite direction.

Motor speed sensing circuits 172 employ an armature current sensing resistor 224 and an armature voltage sensing resistor 226, across which are developed voltages proportional to the current through and voltage applied to pump motor 26. The voltages developed at nodes of current sensing resistor 224 and voltage sensing resistor 226 are filtered by low-pass filter networks 228, 230, and 232 and buffered by unity gain amplifiers 234, 236, and 238.

Unity gain differential amplifiers 240 and 242 sense respectively the voltage across armature voltage sensing resistor 226 and armature current sensing resistor 224 to generate estimated armature voltage and current. The estimated armature voltage and current are filtered by respective low-pass filter networks 244 and 246, and are sampled and digitized by respective A-to-D converters 248 and 250 to generate digital data representing the estimated armature voltage and current.

The armature of pump motor 26 has a measurable DC resistance that causes a predetermined amount of armature voltage to develop as a function of armature current. This relationship follows Ohm's law and can be measured when the armature of pump motor 26 is prevented from rotating. However, when pump motor 26 rotates, the armature not only develops mechanical torque, but also generates a reverse electro-motive force ("back EMF") that subtracts from the voltage across the armature. Thus, for a given amount of current through pump motor 26, the back EMF is estimated as a deficit between the expected Ohm's law voltage and the estimated armature voltage. The deficit is employed to generate estimated motor speed.

Feedback compensating process 174 employs a pair of multipliers 252 and 254 to scale the digital data to fit within the 8-bit value limits imposed by microprocessor 97. The scaled digital data are added by a summing junction 256 to generate a digital number representing the estimated motor speed.

The operation of automatic steering system 10 is described with reference to FIGS. 1 and 4. When power is applied, or when standby button 164 is depressed, automatic steering system 10 enters a standby mode in which bypass valve 54 is open and the steering rate command to steering control loop 92 is zeroed to enable manual steering.

Automatic steering mode is entered by depressing hold button 100, which causes bypass valve 54 to close, heading command register 102 to store and track the current heading, and indicator 166 to illuminate.

A turning mode is entered by depressing either port turn button 160 or starboard turn button 162 to cause bypass valve 54 to close (if not already closed), yaw rate control loop 90 to generate a yaw rate command proportional to the number of port or starboard button depressions, and indicator 166 to illuminate (if not already illuminated).

When in the automatic steering or turning modes, depressing gain up button 108 and gain down button 110, respectively, increases and decreases the forward loop gain of yaw rate control loop 90. Automatic steering effectiveness is reduced at low speeds, such as those encountered when trolling, and is usually restored by a few depressions of gain up button 108.

Figure 7:
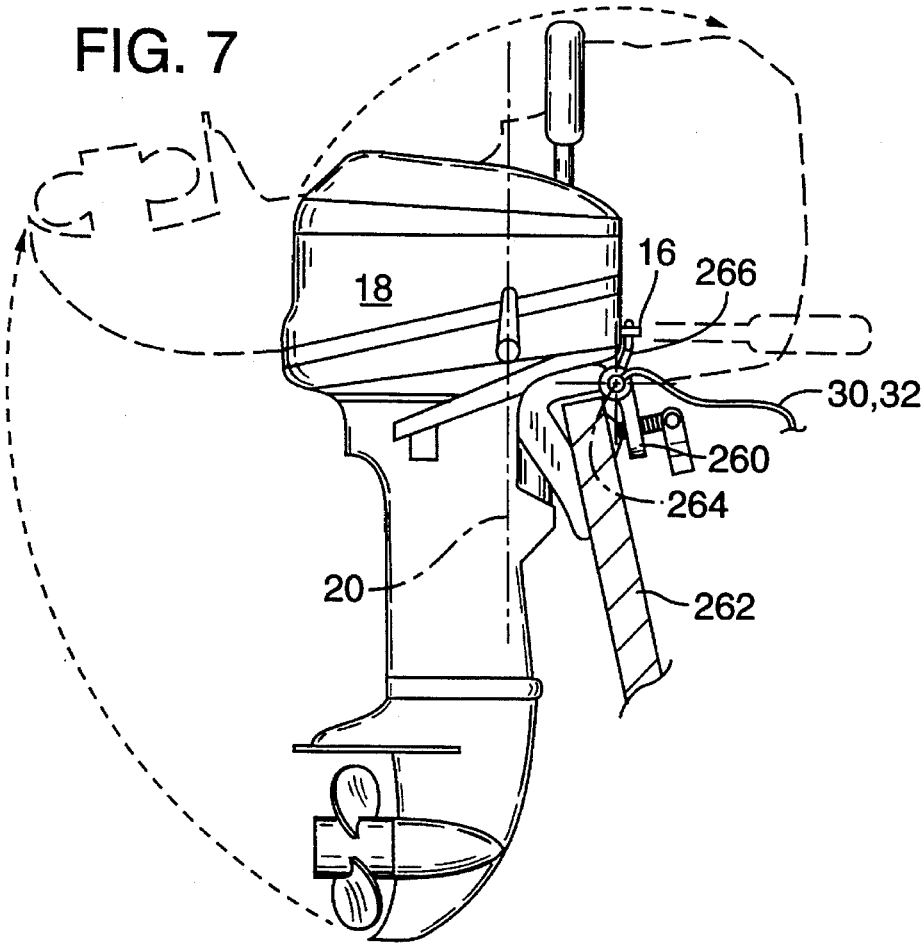
FIG. 7 is a simplified side view of an outboard motor mounted to a watercraft transom showing a hydraulic cylinder of this invention positioned along a tilt tube axis of the outboard motor.

FIG. 7 shows a typical outboard motor 18 mounted by a pair of transom clamps 260 (one shown) to a watercraft transom 262. Outboard motor 18 is shown in an operating orientation and, in phantom lines, tilted about a tilt axis 264. The "hinge pin" through which tilt axis 264 runs is formed from a "half-inch" tilt tube. Outboard motor 18 is also rotatable about axis of rotation 20.

Figure 8:
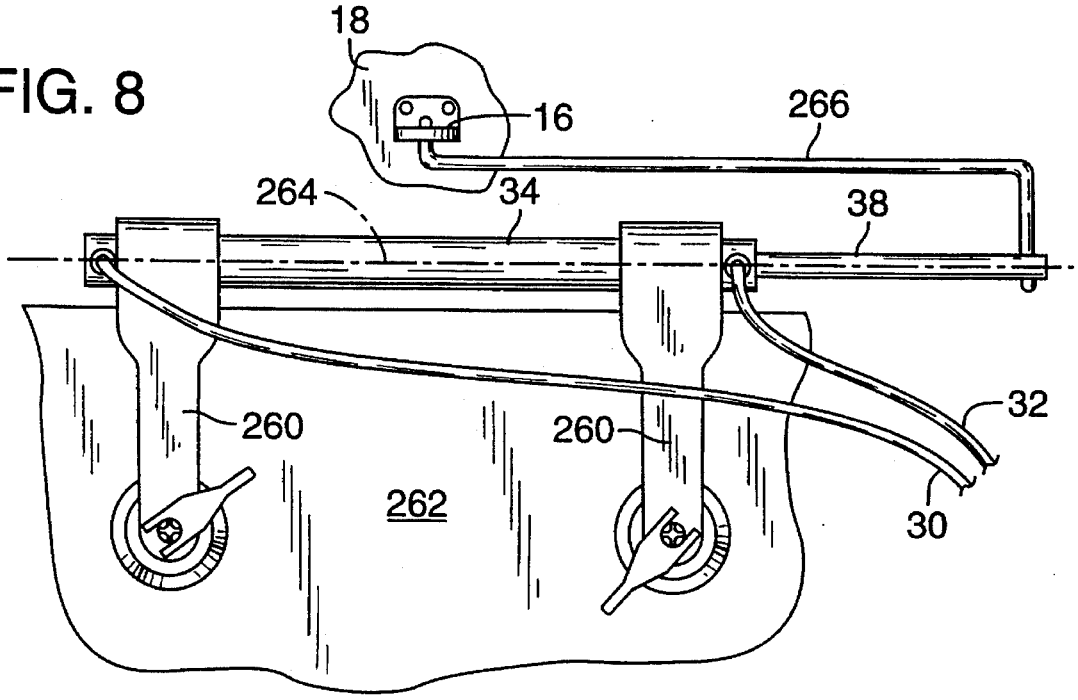
FIG. 8 is a fragmentary front view of the outboard motor tilt tube and associated transom mounting clamps showing the hydraulic cylinder of FIG. 7 positioned along the tilt tube axis together with a piston rod and drag link connected to an outboard motor steering actuator.

In a preferred embodiment of this invention shown in FIG. 8, the tilt tube is replaced with a version of hydraulic cylinder 34 fabricated from half-inch, schedule 40 aluminum tubing having a 1.56 centimeters (0.625 inch) bore in which piston 36 (not shown) is hydraulically actuated by pumping hydraulic fluid through hydraulic lines 30 and 32. FIG. 8 shows a front view of the tilt tube embodiment of hydraulic cylinder 34 mounted by transom clamps 260 to transom 262. Steering actuator 16 is attached to outboard motor 18 (only a fragment shown) and mechanically coupled to piston rod 38 by a drag link 266.

Skilled workers will recognize that portions of this invention may have alternative embodiments. For example, hydraulic cylinder 34 may be differently sized and/or separately mounted to transom 262 and coupled to steering actuator 16 by a version of drag link 266 adapted to compensate for positional differences between tilt axis 264 and the longitudinal axis of hydraulic cylinder 34. Moreover, hydraulic cylinder 34 need not be coupled directly to outboard motor 18, but may instead deflect an auxiliary rudder or a control tab positioned in the thrust stream of outboard motor 18.

Mode controller 98 is preferably remotely connected to automatic steering system 10 by a link 270, that is preferably a wired link or alternatively by a wireless link such as a radio frequency link, a infrared link, or an ultrasonic link. Moreover, port and starboard turn buttons may be replaced by a mini-wheel or a left-center-right rocker switch to provide more intuitive steering control.

Another alternative embodiment of mode controller 98 may employ only a hold/standby button mounted on the tiller handle of outboard motor 18. In this embodiment, an optional mode controller (wired or wireless) includes buttons for the other operating modes and may control special modes such as stored courses and programmable fishing patterns.

A LORAN/GPS steering interface may be adapted to an appropriate point, such as heading command register 102, within yaw rate control loop 90 to provide waypoint steering.

Outboard motor 18 may be fitted with an optional tachometer output for interfacing with loop gain multiplier 156 to eliminate the need for gain up and gain down buttons 108 and 110 on mode controller 98.

Outboard motor 18 may also be fitted with a tiller load sensor that actuates bypass valve 54 to automatically disengage automatic steering system 10.

Skilled workers will realize that automatic steering system 10 can be adapted to motor- or sail-powered watercraft that are steered by wheels or tillers coupled by hydraulic or cable mechanisms to a variety of steering actuators.

Of course, various suitable combinations of analog and digital circuits or microprocessor functions may be employed to implement this invention.

It will be obvious to those having skill in the art that many changes may be made to the details of the above-described embodiments of this invention without departing from the underlying principles thereof. Accordingly, it will be appreciated that this invention is also applicable to automatic steering applications other than those found in small watercraft. The scope of the present invention should, therefore, be determined only by the following claims.

We claim:

1. An automatic steering system for a watercraft, comprising:

an electric compass providing current heading data associated with the watercraft;

a rate taker generating from the current heading data a yaw rate signal;

a yaw rate control loop storing desired heading data, determining from the desired heading data and the current heading data a heading error, and combining the heading error with the yaw rate signal to generate a steering rate command;

a steering control loop receiving the steering rate command and causing a pump motor and a pump coupled thereto to rotate at a rotational speed commanded by the steering rate command such that a hydraulic fluid is pumped through a hydraulic cylinder to move a piston rod at a rate proportional to the rotational speed of the pump; and a mechanical link connecting the piston rod to a steering actuator such that the steering rate command causes the piston rod to move the steering actuator in a manner that causes the watercraft to hold the desired heading.

2. The system of claim 1 in which the current heading data comprise a sine signal and a cosine signal, and the rate taker includes:

first and second differentiator circuits differentiating the respective sine and cosine signals to generate respective differentiated sine and cosine signals;

a first multiplier multiplying the cosine signal by the differentiated sine signal to generate a first number;

a second multiplier multiplying the sine signal by the differentiated cosine signal to generate a second number; and a summing means combining the first and second numbers to generate the yaw rate signal.

3. The system of claim 1 in which the steering actuator is directly attached to an outboard motor.

4. The system of claim 1 in which the hydraulic cylinder is a double-acting single piston hydraulic cylinder.

5. The system of claim 1 in which the watercraft is propelled by outboard motor that is tiltable about a tilt tube and the hydraulic cylinder is integral with the tilt tube.

6. The system of claim 1 further including a mode controller having a hold means that causes the yaw rate control loop to store desired heading data in response to actuating the hold means.

7. The system of claim 6 in which the mode controller is a handheld controller that is remotely linked to the yaw rate control loop by a linking means selected from one of an electrical wiring link, a radio frequency link, an infrared link, and an ultrasonic link.

8. The system of claim 6 in which the mode controller further includes port and starboard turn control means that add a turning rate constant to the yaw rate control loop.

9. The system of claim 1 in which the steering control loop employs a pump motor back-electromotive-force determining circuit to control the rotational speed of the pump motor.

10. The system of claim 1 further including a bypass valve having an open state in which the hydraulic fluid is shunted around the pump to disable the automatic steering system and enable a manual operation of the steering actuator.

11. The system of claim 10 in which the bypass valve further includes a closed state that enables the automatic steering system, and in which the bypass valve returns to the open state in response to any one of an outboard motor tiller load-sensing means, a standby mode button depression, and a disconnection of an electrical power source from the automatic steering system.

12. In a watercraft having a control system in which a variable-speed pump pumps hydraulic fluid through a double-acting hydraulic cylinder to move a piston therein that is coupled to a steering actuator that determines a current heading, an improved automatic steering method comprising:

generating a turning rate signal;

pumping fluid into the hydraulic cylinder to move the piston in a direction and at a rate proportional to the turning rate signal;

detecting a yaw rate of the watercraft and generating therefrom a yaw rate signal; and feeding the yaw rate signal back to the generating step to regulate the turning rate signal.

13. The method of claim 12 in which the generating step includes receiving the current heading as current heading data generated by an electric compass and detecting step includes differentiating the current heading data.

14. The method of claim 13 in which the generating step further includes storing desired heading data and determining a difference between the current heading data and the desired heading data.

15. The system of claim 14 in which a magnitude of the turning rate signal is proportional to the yaw rate signal and the difference between the current heading data and the desired heading data.

* * * * *